United States Patent [19]

Brummett et al.

[11] 3,937,857

[45] Feb. 10, 1976

[54] CATALYST FOR ELECTROLESS DEPOSITION OF METALS

[75] Inventors: Charles Roscoe Brummett, Harrisburg; Ray Ned Shaak, Lebanon; Daniel Marshall Andrews, Harrisburg, all of Pa.

[73] Assignee: AMP Incorporated, Harrisburg, Pa.

[22] Filed: July 22, 1974

[21] Appl. No.: 490,817

[52] U.S. Cl. ..... 427/98; 427/229; 427/226; 427/261; 427/282; 427/306; 427/307; 156/3

[51] Int. Cl.[2] ..... B05D 5/12

[58] Field of Search..... 117/217, 201, 212, 71 R, 117/47 A, 45; 427/306, 229, 259, 261, 282, 307, 98, 226; 156/3

[56] References Cited

UNITED STATES PATENTS

| | | | |
|---|---|---|---|
| 3,370,973 | 2/1968 | Romankiw | 117/71 R |
| 3,509,624 | 5/1970 | Boucher | 427/98 |
| 3,684,534 | 8/1972 | Emerson | 117/47 A |
| 3,697,319 | 10/1972 | Feldstein | 427/229 |
| 3,704,156 | 11/1972 | Foley, Jr. et al. | 427/307 |
| 3,745,095 | 7/1973 | Chadwick et al. | 117/47 A |
| 3,767,538 | 10/1973 | Politycki et al. | 427/307 |
| 3,767,583 | 10/1973 | Fadgen, Jr. et al. | 117/47 A |
| 3,791,848 | 2/1974 | DeAngelo | 427/307 |

*Primary Examiner*—Cameron K. Weiffenbach
*Attorney, Agent, or Firm*—Russell J. Egan, Esq.

[57] ABSTRACT

A solvent method for the metallization of a non-conductive surface with gold, nickel or copper is shown whereby on a substrate a thermosensitive coordination complex of palladium is deposited; the complex has the formula LmPdXn wherein L is a ligand or unsaturated organic radical, X is a halide, alkyl group or a bidentate ligand and *m* is an integer from 1 to 4 and *n* is from 0 to 3; trimethyl phosphite palladium dichloride complex is an appropriate illustration of the complex; the palladium complex is applied on the substrate in a suitable non-aqueous solution such as tetrahydrofuran solution; the complex is then baked in air at elevated temperature; the exposure to high temperature decomposes the complex leaving a residue which is catalytic to the deposition of gold, nickel, cobalt or copper from an electroless bath thereof; the non-conductive material is then immersed in an electroless bath to metallize the areas which have been rendered catalytic; the preferred thermosensitive coordination complex of palladium is trimethyl phosphite palladium dichloride; a requirement for a proper thermal exposure of the complex is that the substrate is capable of withstanding the elevated temperatures such as above 210°C; illustrative organic substrates are polyimides, polysulfones, silicones, vulcanizates, fluoroplastics, polyphenylene sulfides, polyparabanic acids, and polyhydantoin, etc.

20 Claims, 1 Drawing Figure

CATALYST FOR ELECTROLESS DEPOSITION OF METALS

Figure 1:
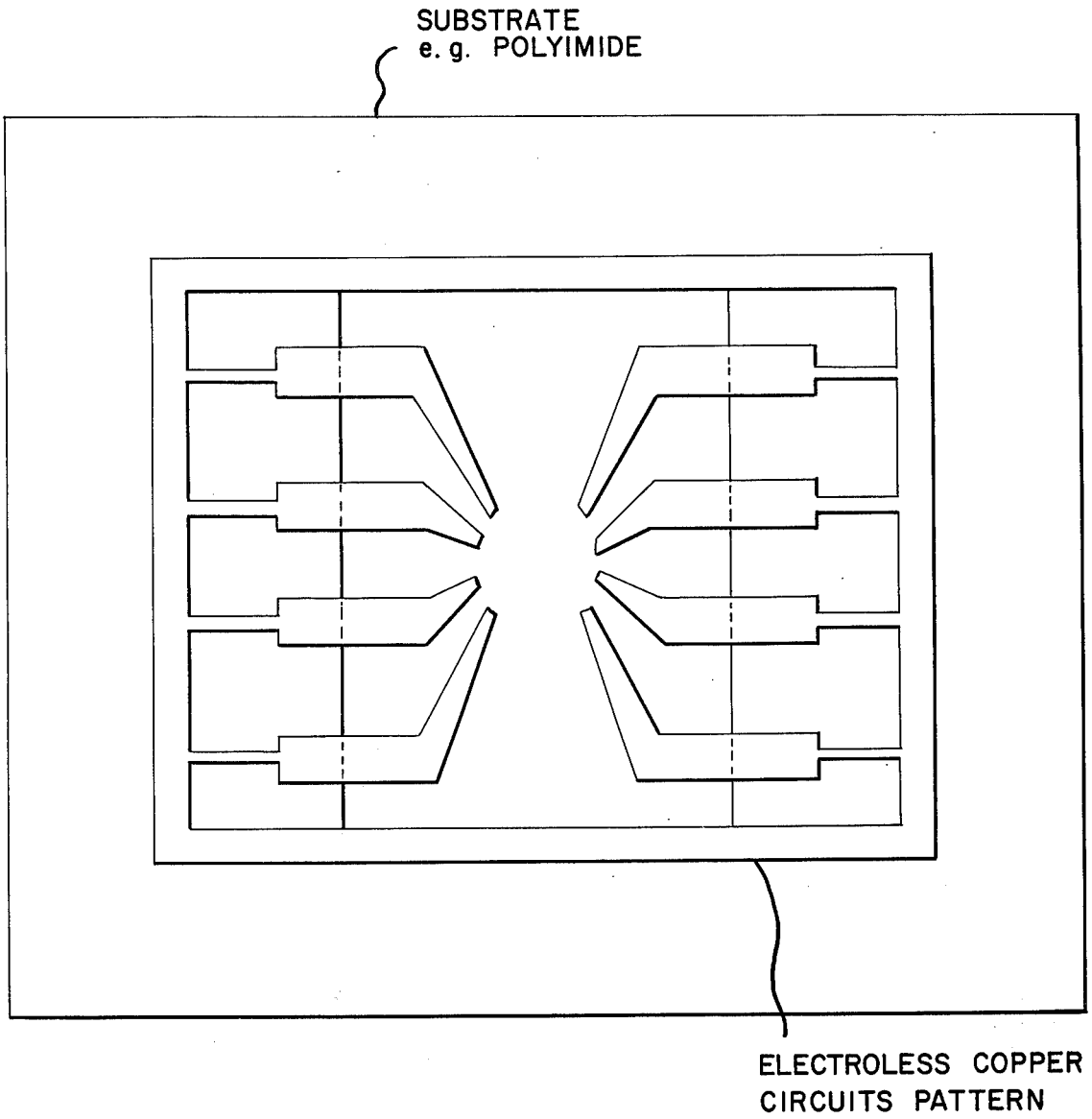

This invention relates broadly to a process for metallizing non-conductive surfaces by depositing metals from electroless metal plating baths. More specifically, this invention relates to a thermal decomposition, on a non-conductive substrate, of a desired layer of a thermal decomposition product which is catalytic to gold, nickel, cobalt or copper in an electroless bath for deposition of these metals on the substrate. More particularly, this invention relates to a process for manufacturing flat-flexible or additive and semi-additive circuitry by thermally decomposing a composition deposited as a continuous thin film on a substrate. A coordination complex of precious metal compound applied to a non-conductive substrate and thereafter decomposed will deposit thereon metal from an electroless bath on the residue of the film in a pattern or as a continuous film; the residue of the complex renders catalytic the deposited area to the metal ion in the electroless bath. This decomposition permits, by additive electroless process or semi-additive process the subsequent formation of circuit pattern of intricate design and desirable resolution. With respect to the semi-additive process the resist and back etch operation is with respect to the electroless deposit only. However, the subtractive process whereby an electrolytic deposit is made and then the same is appropriately backetched is also possible when practicing the present method.

Printed circuits and flat flex circuitry have been used in numerous electrical and electronic applications in many industries. A number of methods for producing selected metallic patterns on a variety of non-conductive surfaces are known and these processes include electroplating, electroless plating as well as various printing processes, and etching processes.

It has been recognized that satisfactory products and good economy are achieved when using electroless plating techniques to deposit the metal upon selected areas of the non--conductive surface. In general, electroless plating requires a sensitization of the substrate in the areas upon which metal is to be deposited from electroless solution. This sensitization is achieved by providing a pattern of a salt of precious metal on the substrate in the areas where it is desired to reduce the electroless metal from the solution thereof.

The emplacement of the salts which are catalytic to the reduction of electroless metal may be accomplished by the well - known techniques of complete coverage of the substrate or masking the substrate or selectively applying the catalytic material as by silk screening or by the use of photographic techniques. These techniques and the techniques for depositing the thin film of metal from an electroless solution are disclosed in numerous patents, among them U.S. Pat. Nos. 3,259,559, 3,562,005 and 3,377,174.

Several problems have been associated with prior art processes. It is most important to ensure that there is satisfactory adhesion between the precious metal catalytic deposit and the subsequently deposited electroless metal. If the adhesion is insufficient, the circuits fail such as when subjected to mechanical handling or heat shock and the conductive layer may become separated from the substrate. Other techniques have produced copper, nickel or gold deposits which are brittle and which bend or otherwise exhibit unsatisfactory ductility in service.

Moreover, there are a number of disadvantages inherent in prior art techniques for producing the metallized pattern on the non-conductive surfaces. For example, in masking techniques, the problems of registration of the mask and poor edge definition of the metallic pattern are serious and the inefficiencies and expenses associated with wasting the mask where it comprises a photo resist are self-evident. Other problems associated with masking are that various solvents must be used, some of which may have a deleterious effect on the catalysts. Where photographic techniques are used, the process is more difficult to carry out because the photographic emulsions must be protected from ambient light conditions to prevent non-selective fixing of the catalytic material. The number of processing steps required for development is relatively large with attendant cost and inefficiency and the final product has often been found to have an unacceptable surface roughness.

It has now been found that contrary to prior art experience, in processes wherein the catalyst is emplaced on the desired substrate and heating steps are involved to drive off the volatile ligand components from the complex and the carrier solvent for the complex, the employment of the desired complex such as of the formula $[(CH_3O)_3\ P]_2PdCl_2$, in combination with the proper solvent, has little damaging effect upon the substrate. It has been found that an electroless coating upon the so-prepared substrate has an acceptable surface smoothness and especially adhesion.

It is therefore the primary object of this invention to provide an improved method for depositing electroless metal upon a non-conductive substrate.

It is a further and more specific object of this invention to provide a thermal decomposition process wherein a material catalytic to the reduction of electroless metal is deposited as a continuous film upon a non-conductive surface.

It is a further and related object of this invention to provide such a process which is efficient to use and which achieves the production of a strong and adherent conductor pattern on a variety of inexpensive, flexible insulating materials.

It is a further related object of this invention to provide a process which produces flexible substrates which are capable of being soldered, useful for printed circuits and flat flexible circuitry, and which substrates are durable, heat resistant and inexpensive and are built on an organic, polymeric base which will withstand the thermal and mechanical stress of electrical discharge, thermocompression, and dip soldering as a means of attaching conductor leads to said circuitry.

It is a further and more specific object of this invention to provide a technique for depositing upon a non-conductive substrate material which is catalytic to the subsequent reduction of gold, nickel, cobalt or copper from an electroless bath thereof and to achieve this catalyzation of the non-conductive surface by a thermal decomposition technique which is simple and efficient to use.

It is a further and related object of this invention to provide a thermo-decomposable complex of a metallic salt in combination with a solvent providing a reaction which is catalytic to reduction of electroless metal.

These and other objects of this invention are achieved in a method for the general electroless deposition of metals upon a non-conductive substrate on a polyimide film wherein a thin film of a thermosensitive coordination complex of palladium is first applied to the substrate.

As an illustration of a suitable circuit, FIG. 1 shows a lead frame produced when practicing the present invention.

The coordination complex of palladium has the formula:

$L_mPdX_n$ wherein L is a ligand or unsaturated organic group; Pd is the palladium metal base of the complex; X is a halide, alkyl group, or bidentate ligand; and *m* and *n* are integers, i.e., *m* is from 1 to 4 and *n* is from 0 to 3.

In the complex above L is: a phosphine moiety or a phosphite moiety each is substituted with substituents such as aromatic mononuclear (e.g. phenyl) or polynuclear (e.g. naphthyl) or an alkyl group or mixed alkyl groups of 1 to 10 carbon atoms in the alkyl group; a nitrile such as an aromatic nitrile e.g. benzonitrile or an aliphatic nitrile e.g. acetonitrile generally having up to 8 carbon atoms in said nitrile moiety; a diene such as an aliphatic diene from 4 to 8 carbon atoms e.g. 1,3-butadiene or an alicyclic diene e.g. a cyclooctadiene; or an amine e.g. alkylene di- or tetraamine of 2 to 4 carbon atoms in the alkylene portion thereof such as triethylene tetramine, ethylene diamine; triethanol amine, diethanol alkylamine of 1 to 4 carbons in the alkyl group, etc.

Platinum complexes of the above will also be suitable except from cost standpoint. Nickel and copper complexes were tried, but thermal decomposition yielded only metal oxides which were not catalytic.

Representative compounds are:

Bis-triphenylphosphine palladium dichloride, bis-triphenylphosphine dimethyl palladium, bis(triphenylphosphine) di(secondarybutyl) palladium, bis-triphenylphosphine palladium oxalate, bis-triphenylphosphine palladium borohydride, bis-triphenylphosphine palladium diamine, tris-triphenylphosphine palladium chloride, tetrakis-triphenylphosphine palladium (0); bis-triethyl phosphine and bis-tri-n-butyl phosphine palladium chloride or the dialkyl e.g. dimethyl, dibutyl, etc., oxalate, and borohydride substituents of the complex, bis-trimethylphosphite palladium dichloride or the dialkyl e.g. dimethyl, disec.butyl, etc., oxalate, succinate, citrate, and borohydride substitutions, bis-benzonitrile and bis-acetonitrile palladium dichloride, 1,3-butadiene palladium dichloride, and bis-triethylene tetramine palladium dichloride and bis-triethylene tetramine palladium oxalate. With respect to alkyl moieties, described above, these are generally from 1 to 6 carbon atoms, preferably from 1 to 4 carbon atoms.

Synthesis of the above-mentioned bis-trimethylphosphite palladium dichloride and related compounds will now be described.

Palladium-phosphorous coordination complexes are synthesized specifically by slowly adding organo-phosphine or organo-phosphite compounds to an organic solvent slurry of palladium dichloride at reduced temperature. These complexes may be purified by freezing the pure crystals from a saturated solution of a suitable solvent. Bis-trimethylphosphite palladium dichloride, for example, is produced by slowly adding trimethylphosphite to an acetone slurry of palladium dichloride at ice water temperature. Crystals may be purified in tetrahydrafuran by freezing the saturated solution. The alkyl substituted compounds are made by adding lithium alkyl to the desired organo-phosphorus metal chloride complex in an ether solution. Chloride moieties are replaced with the corresponding alkyl group or groups. Oxalate or borohydride substitutions are made by adding sodium oxalate or sodium borohydride to an ether solution of the desired chloride complex. Tetrakis, zero valent (0), complexes are synthesized by adding an additional quantity of organo-phosphorus compound to an organic solution of the bis-organo phosphorus metal dichloride, an then adding a strong reducing agent such as hydrazine. The chloride moiety is displaced leaving a metal atom with four organo-phosphorus ligands coordinated with a net zero valence.

In general, the palladium complex materials can be synthesized by simple precipitation and filtration, or solvent evaporation procedures, and stored as crystals or in solutions until needed for specific product applications. Such applications may include besides the previously described surface catalyzation of non-conductive materials, the also previously described, electroless and nonaqueous immersion plating of palladium, electrolytic deposition of palladium and chemical vapor deposition of palladium on a heated substrate. Before a successful deposit can be made, the substrate must be prepared in an appropriate manner.

Illustrative moieties of the above complexes are set forth below; preparation of these show the numerous complexes which may be synthesized.

1. Bis-triphenylphosphine palladium dichloride $[(C_6H_5)_3P]_2PdCl_2$. Dissolve 2 moles, plus 5% excess, of triphenylphosphine in acetone. Dissolve 1 mole of palladium dichloride in water with a slight excess of chloride ion ether from HCL or KCL. Slowly pour phosphine solution into palladium solution with stirring till lemon yellow precipitate complete (10 min.). Filter crystals and wash first with water then with acetone. Dried crystals represent 94% of theoretical yield.

2. Tetra-kis-triphenylphosphine palladium zero valent -$[(C_6H_5)_3P]_4Pd°$ decomp. temp. 98°C. Slurry 1 mole of bis-triphenylphosphine palladium dichloride and 2 moles, plus 5% excess, of triphenylphosphine in ethanol under nitrogen. Add 2–½ moles of hydrazine in ethanol dropwise to the stirring solution. Stir for one-half hour. Filter, wash with ethanol, dry in vacuum.

3. Bis-triphenylphosphine palladium dimethyl -$[(C_6H_5)_3P]_2Pd\ (CH_3)_2$ decomp. temp. 275°C. Place 1 mole of bis-triphenylphosphine palladium dichloride in an ether slurry. Add 2 moles of methyl lithium, plus a 15% excess, in ether solution, and allow to stir for 1 hour to insure complete alkyl displacement of chloride ligands. Filter, wash with water and then with ether to remove all lithium chloride and unused lithium alkyl. Dry in air.

4. Bis-tri-n-butylphosphine palladium dichloride -$[(C_4H_9)_3P]_2PdCl_2$ Decomp. temp. 155°C. Dissolve 2 moles, plus a 5% excess, of tri-n-butyl phosphine in methanol. Slurry 1 mole of anhydrous palladium dichloride in acetone. Slowly pour the phosphine solution into the palladium slurry with stirring. Crystals are obtained by evaporating solvents. Avoid contact with water; this complex forms unstable hydrates.

5. Bis-tri-n-butylphosphine palladium dimethyl -$[(C_4H_9)_3P]_2Pd\ (CH_3)_2$ decomp. temp. 145°C. Dissolve 1 mole of bis-tri-n-butylphosphine palladium dichloride in ether. Add 2 moles, plus a 5% excess, of methyl lithium slowly and allow to stir for 10 min. Evaporate to dryness with air. Crystals melt at 60°C and begin to evaporate if decomposition temperature is not reached quickly. Material decomposed by U.V. light.

6. Bis-triethylphosphine palladium dichloride -$[(C_2H_4)_3P]_1PDCl_2$ decomp. temp. 150°C. Slowly pour solution of 2 moles of triethylphosphine in alcohol, plus 5% excess, into slurry of anhydrous palladium dichloride in acetone with stirring. Evaporate to dryness. Avoid contact with water; this complex forms highly unstable hydrates.

7. Bis-triethylphosphine palladium dimethyl -$[(C_2H_5)_3P]_2Pd(CH_3)_2$ decomp, temp. -- Dissolve 1 mole of bistriethylphosphine palladium dichloride in ether. Add 2 moles, plus 5% excess of methyl lithium slowly and allow to stir for 10 min. Evaporate to dryness with nitrogen. Material decomposes in air and is extremely U.V. sensitive.

8. Bis-triphenylphosphine palladium disecondary butyl -$[(C_6H_3)_3P]_2Pd[CH_3)CHC_2H_5]_2$ decomp. temp. -- Place 1 mole of bis-triphenylphosphine palladium dichloride in an ether slurry. Add 2 moles of secondary butyl lithium plus a 5% excess and allow to stir for 1 hour. Remove crystals by filtration. Wash with water and then with ether and dry in air.

9. Bis-triphenylphosphine palladium oxalate -$[(C_6H_5)_3P]_2PdC_2O_4$ decomp. temp. 293°C. Dissolve 1 mole of bis-triphenylphosphine palladium dichloride in acetone. Slurry 1 mole plus 5% excess of sodium oxalate in water. Pour phosphine solution into oxalate slurry and allow to stir for 10 min. Filter crystals and dry.

10. Bis-triethylphosphine palladium oxalate -$[(C_2H_5)_3P]_2PdC_2O_4$ decomp. temp. 275°C. Dissolve 1 mole of bis-triethylphosphine palladium dichloride in alcohol. Slurry 1 mole plus 5% excess of sodium oxalate in acetone. Pour the phosphine solution into the oxalate slurry and allow to stir for 10 min. Crystals are obtained by evaporating solvents.

11. Palladium acetylacetonate - $Pd(C_5H_7O_2)_2$ decomp. temp. 240°C. Place 1 mole of palladium dichloride in water solution with a slight excess of chloride ion as from HCl. Place 2 moles plus a 5% excess of sodium acetylacetonate in water solution. Mix the two solutions slowly with stirring and allow to stir for 20 min. Filter the crystals and wash with water.

12. Bis-triphenylphosphine palladium borohydride -$[(C_6H_5)_3P]_2Pd\ (BH_4)_2$ decomp. temp. -- Place 1 mole of bis-triphenylphosphine palladium dichloride in an acetone slurry. Dissolve 2 moles of sodium borohydride, plus 5% excess, in a high molecular weight alcohol. Slowly pour the borohydride solution into the chilled phosphine slurry with stirring. After 5 minutes of stirring evaporate to dryness with nitrogen gas. Store in dark freezer.

13. Bis-trimethylphosphine palladium dichloride -$[(CH_3O)_3P]_2PdCl_2$ decomp. temp. 210°C. Place 1 mole of palladium dichloride in acetone slurry. Add 2 moles of trimethyl phosphite dropwise with stirring, allow to stir for 2 hours. Evaporate to dryness and redissolve in warm tetrahydrafuran. After shaking warm solution in calcium chloride crystals filter through fine pore filter. Complex recrystallizes on cooling and may be filtered and washed with cold tetrahydrafuran.

14. Bis-benzonitrile palladium dichloride $(C_6H_5C \equiv N)_2PdCl_2$ decomp. temp. 85°C. Place 2 gm of palladium dichloride in 50 ml of benzonitrile and warm mixture to 100°C. After 30 min. of stirring at 100°C. the palladium dichloride will dissolve to give a red solution. After filtering, the still warm solution is poured into 300 ml of petroleum ether to precipitate out the crystals. Crystals are removed by filtration and washed with cold petroleum ether.

15. 1,3-butadiene palladium dichloride - $C_4H_6PdCl_2$ decomp. temp. 95°C. Place 2 gm of bis-benzonitrile palladium dichloride in a benzene solution. Bubble 1,3-butadiene through solution till color becomes yellow. Continue bubbling till crystals no longer fall out. Filter crystals.

16. Bis-acetonitrile palladium dichloride -$(CH_3C \equiv N)_2$ decomp. temp. 130°C. Place 2 gm of palladium dichloride in 20 ml of acetonitrile and warm till all palladium dichloride dissolves. Vacuum filter while still hot, then cool to precipitate crystals. Filter.

17. Bis-triethylenetetramine palladium oxalate -$[H_2NCH_2(CH_2NHCH)_2CH_2NH_2]Pd°C_2O_4$. Dissolve 1 mole of palladium dichloride in water. Dissolve 2 moles plus 5% excess of triethylenetetramine in water. Mix the two solutions and stir for 30 min. Add 2 moles of silver nitrate aqueous solution and stir till all silver chloride precipitates. Filter silver chloride and add 1 mole of sodium oxalate to filtrate.

With respect to the polymer film, sheets, slats, shapes, or forms, the surface preparation is as follows. A polymer such as polyimide film is first degreased by a solvent dip. The most suitable degreasing agents are fluorinated hydrocarbons such as Freon; other effective degreasing agents are chlorinated hydrocarbons such as 1,1,1-trichloroethane, trichloroethylene and carbon tetrachloride; and aromatic solvents such as xylene, toluene and chlorobenzene.

After degreasing, the polymer film such as polyimide film is dipped in a caustic solution for one minute which attacks the imide linkage of the polymer, removes some low molecular weight fractions and generates a thin gel like coating on the surface. After a water rinse, the film is dipped in an acid solution, e.g. citric acid to neutralize the caustic. The film is then washed in deionized water and dried at 80°–100°C with care not to set the thin gel like coating; or the washed film may be dried with an air jet. The caustic surface conditioning improves adhesion of the metal to the polyimide film (such as Kapton) reduces porosity in the coating and eliminates blistering.

A number of caustic based solutions have been used for surface conditioning of polyimide films. Sodium hydroxide solutions ranging in concentration from 4 to 20% have been used with success. Mixtures of 5% sodium hydroxide - 5% hydrazine hydrate have also been successfully used. A mixture of benzene sulfonic acid-phenol-sodium hydroxide at 80°C. in accordance with a method disclosed in U.S. Pat. No. 3,394,023 also successfully was used to condition polyimide film. With this type of catalization process, it was found that a much less drastic surface conditioning was necessary than is required with commercial chemical absorbtion type catalyst processes. A 4% sodium hydroxide solution is preferred for economic reasons. This concentration was found to be quite sufficient to remove the low molecular weight surface material previously mentioned.

Many acids have been used to neutralize the caustic on the surface after conditioning. They include hydrochloric, nitric, sulfuric, hydrofluoric and citric. Citric is the preferred neutralizer because it does not attack or modify the polyimide surface as the inorganic and mineral acids do.

A polyimide film is then dipped into an organic solution of an organo-palladium complex, and withdrawn at a controlled rate; the solvent readily evaporates leaving a thin film of evenly dispersed complex. When the film is heated in air, the complex thermally decomposes leaving a layer of palladium residue which is entrained upon apparently a repolymerization of the gel coating at the polyimide's surface. Subsequent immersion of the film in an electroless gold, nickel or copper bath will produce rapid nucleation of the plating metal on the catalyzed surface.

Teflon and other fluorocarbons may be metallized using the same procedure after the surface has been prepared by etching with a saturated solution of sodium in naphtha (Tetro-etch). Glass plate can also be metallized in this manner, however, the glass surface must be coated with a thin primer coating of epoxy which is first cured to achieve adequate bonding of the plated metal. Most any substrate which will stand a temperature of 210°C. for a few seconds and which is inert to the solvent environment of the catalyst solution can be metallized by this technique.

Suitable inert substrates are described below.

For example, epoxy resins having a temperature capability of 550°F are suitable, tetrafluoro ethylene mentioned above and fluoroethylene polymers of a temperature resistance of at least 400°F are suitable. Other substrates and their useful upper temperature are polyarylsulfone (500°F) polyparabanic acid (550°F— disclosed in U.S. Pats. 3,547,897; 3,591,562; and 3,661,859); the previously mentioned polyimides and polyimides-amides (480°F); polyphenylene sulfide (500°F); polysulfones (345°F); silicone polymers, e.g., dimethyl or diphenyl siloxanes (room temperature vulcanizates—500°F) and poly-2,4-imidazolidinediones (polyhydantions) (manufactured by Bayer A. G. Germany and available from Mobay Chemical, Pittsburg, Pa.). A number of the above polymers are described in Lee et al., *New Linear Polymers*, McGraw-Hill, N. Y., N. Y. (1967).

In general all high temperature polymers, i.e., having a temperature capable of resisting solder dip temperatures of 210°C to 220°C are useful. In accordance with this invention, the preferred polymer substrates are capable of withstanding the above temperatures for a time sufficient in a solder dip (about a 5 to 10 sec. dip). Of the above substrates, the polyimides are the first choice.

The polymers mentioned above may be in sheet, film, slab, or of a desired shape, etc. and may be filled with inert fillers to make the same rigid when necessary.

As a solvent for the catalyst, it must be chosen on the basis of specific criteria. It must be a solvent in which the palladium complex is highly soluble, it must wet and should slightly swell the gel coating at the polyimide's surface, and it must have a sufficiently high vapor pressure that the solvent flashes off quickly and evenly. The preferred solvent for this purpose is tetrahydrofuran. The organic solvents available and which were used successfully include benzene, dimethylsulfoxide, dimethylacetamide, formamide, dimethyl formamide, acetone, methanol, carbon tetrachloride, chloroform, toluene, 1,1,1-trichloroethane, isopropyl alcohol, ethyl ether, methyl ethyl ketone, and mixtures of solvents such as 50% benzene-50% tetrahydrofuran, 90% isopropyl alcohol-10% tetrahydrofuran, and 80% benzene-20% methyl ethyl ketone.

The substrate with the thin film of thermally decomposable complex upon it is then exposed to a hot, and preferably humid, air environment in which the complex is thermally decomposed to the catalytic residue.

In the preferred embodiment, a non-conductive substrate is metallized by applying to it one of a thermally sensitive coordination complex of palladium such as one having the formula: $[(CH_3O)_3P]_2PdCl_2$.

The concentration of the complex or one of the other complexes in a suitable solvent e.g. in the tetrahydrofuran solvent is from 6 gm/l to 25 gm/l and in a series of runs were of a metal concentration of 2.0 to 6.0 gm/l Pd. Preferably, a complex concentration of 12.0 gm/l to 18 gm/l or a metal concentration of 3.0 gm/l Pd to 12.0 gm/l represent a desired concentration. Thereafter the film, catalytic to electroless nickel, copper, gold or cobalt is exposed to a bath suitable for depositing electroless copper, cobalt, nickel or gold which is deposited onto the catalytic film. The desired circuitry areas are then selectively masked and the exposed spaces between the circuitry areas are deactivated such as by slight back etching to assure that the electroless metal as well as the catalytic residue has no effect on the circuit performance.

In the event later back etching of copper or nickel is desired such as after electroless copper deposition of a continuous film, or after electrolytic build up of circuitry areas, further gold or tin - lead or other inert alloy combinations or multimetallic materials of the common solder classes are deposited on the pattern with specific areas masked with an appropriate composition as it is well known in the art. The pattern may be completed by appropriately removing the masking composition and back etching the electroless copper deposit with a suitable etchant which is selective to the metal e.g. copper, such as ammonium persulfate, and which will not attack the overlying metal.

The criteria for choosing the most desirable palladium complex for the thermal-catalyzation of polyimide surfaces include: a material which is readily soluble in the preferred solvent systems; a material chemically stable in air, and stable in solution at operating temperatures; and a thermal decomposition temperature which is optimum for bonding palladium residue to the polymer substrate such as polyimide; thus the complex should not have a decomposition temperature of above 300°C.

The complex found to be most appropriate for the pyrolytic catalyzation of polyimide surfaces is the above-mentioned bis-trimethylphosphite palladium dichloride. The decomposition temperature of this complex is 210°C. A minimum concentration of 8.4 gm/l of the complex, giving a metal concentration of 2.1 gm/l Pd catalyst solution produces a catalyzed polyimide surface on which 9–10 microinches of high integrity nickel deposits after a three minute immersion at 76°C in an agitated electroless nickel bath of the composition identified below as "Electroless Nickel I." Suitable electroless baths are identified herein below.

Electroless Coppers:

| | | |
|---|---|---|
| I. | Copper Sulphate | 10 gm/l |
| | Sodium Hydroxide | 10 gm/l |
| | Formaldehyde (37–41% W/V) | 10 ml/l |
| | Sodium Potassium Tartrate | 50 gm/l |
| II. | Cupric Oxide | 3.0 gm/l |
| | Sodium Hypophosphite | 10 gm/l |
| | Ammonium Chloride | 0.1 gm/l |
| III. | Copper Sulphate | 13.8 gm/l |

-continued

| | | |
|---|---|---|
| Electroless Coppers: | | |
| | Sodium Potassium Tartrate | 69.2 gm/l |
| | Sodium Hydroxide | 20 gm/l |
| | Formaldehyde (36% W/V,* 12.5% $CH_3OH$) | 40 ml/l |
| | 2-Mercaptobenzothiazole | 0.003% |
| | *weight by volume | |
| | Bath Temp: Ambient | |
| Electroless Nickel: | | |
| I. | Nickel Chloride | 80 gm/l |
| | Sodium Citrate | 100 gm/l |
| | Ammonium Chloride | 50 gm/l |
| | Sodium Hypophosphite | 10 gm/l |
| | Bath Temp.: 180°F ±20 | |
| II. | Nickel Chloride Hexahydrate | 20 gm/l |
| | Ethylene Diamine (98%) | 45 gm/l |
| | Sodium Hydroxide | 40 gm/l |
| | Sodium Borohydride | 0.67 gm/l |
| | Bath Temp.: 180°F | |
| Electroless Cobalt: | | |
| I. | Cobalt Chloride Hexahydrate | 30 gm/l |
| | Sodium Citrate Pentahydrate | 35 gm/l |
| | Ammonium Chloride | 50 gm/l |
| | Sodium Hopophosphite, Monohydrate | 20 gm/l |
| | Bath Temp.: 180°F | |
| II. | Cobalt Sulphate, Heptahydrate | 24 gm/l |
| | Ammonium Sulphate | 40 gm/l |
| | Sodium Hypophosphite | 20 gm/l |
| | Sodium Citrate | 80 gm/l |
| | Sodium Lauryl Sulphate | 0.1 gm/l |
| | Bath Temp.: 180°F | |

Other baths which were tried and worked were Shipley NL-63 (a nickel bath), Richardson-NIKLAD 759-A (nickel); Shipley XP7006 (nickel).

Representative electroless copper baths which were used are the following: Dynachem 240; Shipley 328Q; McDermid 9055.

Some of the illustrated baths are well known in the art and reference may be had to U.S. Pat. No. 3,095,309 and 3,546,009 which disclose electroless copper deposition baths and to Brenner, "Metal Finishing" November 1954, pages 68 to 76, which disclose electroless nickel baths. Electroless gold baths are disclosed in U.S. Pats. 3,123,484; 3,214,292; and 3,300,328 the disclosure of which is incorporated by reference. Typically, the electroless metal baths comprise a source of the metal ions, a reducing agent for those ions, a complexing agent and a compound for pH adjustment.

With respect to the above bath the alkali baths are a second choice when using the poly imides, poly imides-amides, poly parabanic acid, or poly hydantoins; an acid or neutral electroless bath is preferred.

EXAMPLE I

A solution of bis-trimethylphosphite palladium dichloride is made by dissolving in tetrahydrafuran at a concentration of 2.1 to 3 gm/l Pd. A piece of polyimide which has been soaked for 1 min. in a 20% sodium hydroxide solution, water rinsed, neutralized in 50% HCl for 1 min., water rinsed, acetone rinsed, and dried at 100°C for 1 min. is dipped in the palladium catalyst solution for 30 sec. As the polyimide strip is withdrawn from the catalyst solution, the tetrahydrafuran solvent flashes off leaving a monomolecular film of bis-trimethylphosphite palladium dichloride complex. The film is then baked in a moist air oven at 210°C to decompose the complex to an adherent film of palladium metal. When the treated film is immersed in an electroless copper bath Shipley 328Q (as well as the copper baths given previously) approximately 5 $\mu$ in. of copper will deposit evenly over the film surface in 2 min. The copper layer is then electrolytically built up to 50–100 $\mu$ in. in a copper sulfatesulfuric acid bath. After washing and drying the metallized film is coated with a photoresist, printed with a suitable circuitry pattern (a lead frame pattern shown in FIG. 1), developed and washed. The film is then put back into the electrolytic copper bath and the circuitry patterns selectively built up to one-half mil over which is plated 500–100 $\mu$ in. of tin lead or other solder alloy. After washing the photoresist is solvent stripped and the exposed non-circuitry base copper is removed with selective etch such as ammonium persulfate, thus leaving a printed flexible circuit ready for solder contacting.

EXAMPLE II

The procedure set forth in Example I is repeated but instead as in Example I bis-triphenylphosphine palladium dimethyl is used as the catalyst complex.

EXAMPLE III

The procedure set forth in Example I is repeated but instead as in Example I palladium complex identified as 4) above is used.

EXAMPLE IV

The procedure as set forth in Example I is used and the complex of Example II is used in a 50—50 mixture of benzene and tetrahydrafuran as the catalyst solvent.

EXAMPLE V

The procedure as set forth in Example I is repeated but citric, or nitric acid, is used to neutralize the caustic.

EXAMPLE VI

The procedure as set forth in Example I is repeated but a 5% sodium hydroxide -5% hydrazine is used as a surface treatment solution.

EXAMPLE VII

The procedure set forth in Example I is repeated but sulfonic acid-phenol-sodium hydroxide is used as a surface treatment solution.

EXAMPLE VIII

The procedure set forth in Example I is repeated but sodium hydroxide from 4–20% is used for surface preparation of a film of poly imide-amide or poly parabanic acid.

EXAMPLE IX

The procedure set forth in Example I is used and an electroless metal bath of nickel, cobalt and gold is used and deposits of good quality are obtained.

EXAMPLE X

The procedure is repeated as in Example I but nickel is used in the circuitry as defined in bath "Electroless Nickel I."

EXAMPLE XI

The procedure is repeated as in Example I but the initial deposit of copper is then masked, the electroless copper deposit back etched rather than building up the circuitry.

With respect to electrolytic deposits which are employed to build up the circuit patterns electrolytically, the following baths are suitable:

| | | |
|---|---|---|
| a. | Copper Sulfate | 28.0 oz./gal |
| | Sulfuric Acid | 7.0 oz./gal |
| | Room Temp. Bath | (15 to 25°C) |
| | ASF (amperes per square foot) | about 10 |
| or: | | |
| b. | Copper Fluoroborate | 60 oz./gal |
| | Copper (as metal) | 16 oz./gal |
| | Temp. of Bath - 120°F | |
| or: | | |
| c. | Copper Cyanide | 2–3.5 oz./gal |
| | Sodium Cyanide | 3.7–5.9 oz./gal |
| | Free Sodium Cyanide | 1.5–210 oz./gal |
| | Sodium Hydroxide | 0–1/2 oz./gal |

Further, tin may be overplated for better solder adhesion. Typical tin, as well as tin-lead electrolytic compositions, are listed in "Metals Finishing Guidebook Directory", Metal and Plastic Publications Inc., Westwood, N.J. (published annually). This publication also provides sufficient description of various other electrolytic compositions suitable for flat and/or flexible circuitry uses (as well as electroless baths).

In accordance with the above method and when the circuit pattern on a Kapton (H-film, i.e., polyimide) was overplated with the electrolytic copper deposit from bath a. above, peel strength (90° peel test) values of as high as 4.5 psi have been observed for a one mil film with a one mil overplate.

What is claimed is:

1. A method for the decomposition of a metal into an inert substrate from a bath containing said metal, said metal comprising the steps of:

applying to said substrate a thin film of a thermally decomposable complex of palladium or platimum having the formulae LmPdXn or LmPtXn wherein L is a ligand or an unsaturated organic group; Pd or Pt is palladium or platinum metal; X is a halide, an alkyl group or a bidentate ligand; and *m* is from 1 to 4 and *n* is from 0 to 3;

exposing said substrate to which said complex has been applied to heat at a temperature of about 300°C and less to effect decomposition of said complex and to create a residue catalytic to a metal in an electroless bath solution; and depositing a metal from said electroless bath on said substrate in an area rendered catalytic by decomposition of said complex.

2. The process as defined in claim 1 and wherein the complex is bis-trimethylphosphite palladium dichloride.

3. The method as defined in claim 1 and wherein said ligand L is a phosphine moiety, a phosphite moiety; a nitrile moiety; a diene moiety; a diamine, a tetramine; diethanol alkyl amine; or a triethanol alkyl amine; X is a halide, i.e., chloride, bromide, or iodide, an alkyl group of 1 to 6 carbon atoms, or a bidentate ligand of oxalate, succinate, citrate or borohydride.

4. As an article of manufacture, a polyimide film having a circuit pattern thereon defined by an electroless metal deposit and as catalyst for said electroless deposit a thermal decomposition product of a complex defined in claim 1.

5. A method for the metallization of a non-conductive substrate with nickel, cobalt, gold or copper comprising the steps of:

a. applying to said substrate a thermally sensitive, coordination complex of palladium or platinum having the formula LmPdXn or LmPtXm b. forming residue catalytic to electroless nickel, cobalt, gold or copper on said substrate by decomposing the said complex at a temperature from 210°C to 300°C; and immersing said substrate in an electroless solution of nickel, cobalt, gold or copper and depositing nickel, cobalt, gold or copper therefrom on the catalytic film formed by decomposition of said palladium or platinum complex.

6. A process as recited in claim 5 wherein the palladium complex is trimethyl phosphite palladium dichloride.

7. A process as recited in claim 5 wherein the said substrate after application of said complex and electroless metal in a nickel, cobalt, or copper electroless bath solution is masked and exposed to further additive electroless deposition.

8. A process as recited in claim 7 wherein said substrate after said further additive deposition is stripped of said mask and back etched in areas wherein said electroless metal has been deposited.

9. A method for the preparation of an inert substrate to electroless deposition of a metal upon said substrate comprising the steps of:

a. applying to said substrate a thin film of a thermally decomposable coordination complex of palladium having the formula LmPdXn wherein L = a ligand or unsaturated organic group, Pd is metal palladium and X = a halide, alkyl group or bidentate ligand,

*m* is an integer from 1 to 4 and *n* is from 0 to 3, and b. exposing said substrate to which said complex has been applied, to heat, at a temperature of about 300°C and less, to effect decomposition of said complex and create residue catalytic to a metal in an electroless bath.

10. The process as defined in claim 9 and wherein the complex is bis-trimethylphosphite palladium dichloride.

11. A process as recited in claim 9 wherein said complex is bis-triphenylphosphine palladium dimethyl.

12. A process as recited in claim 9 wherein said complex is bis-tri-n-butylphosphine palladium dichloride.

13. A process as recited in claim 9 wherein said complex is palladium acetylacetonate.

14. The process as defined in claim 9 and wherein the substrate is etched before applying said complex to same.

15. The process as defined in claim 9 and wherein a complex or a mixture of complexes is applied to said substrate and said complex is bis-triphenylphosphine palladium dichloride; bis-triphenylphosphine dimethyl palladium; bis(triphenylphosphine) di(secondarybutyl) palladium; bis-triphenylphosphine palladium oxalate; bis-triphenylphosphine palladium borohydride; bis-triphenylphosphine palladium diamine; tris-triphenylphosphine palladium chloride; tetrakis-triphenylphosphine palladium (0); bis-triethyl phosphine or bis-tri-n-butyl phosphine palladium chloride or the dialkyl, oxalate, and borohydride bidentate substituents of said complex; bis-trimethylphosphite palladium dichloride or the dialkyl oxalate, succinate, citrate, and borohydride bidentate substituent of said complex; bis-benzonitrile, palladium dichloride; bis-acetonitrile palladium dichloride, 1,3-butadiene palladium dichloride; bis-triethylene tetramine palladium dichloride or bis-triethylene tetramine palladium oxalate, or mixtures thereof; said alkyl moieties, defined above, being from 1 to 6 carbon atoms.

16. The method as defined in claim 9 and wherein the ligand is a phosphite or phosphine substituted with (a) aromatic mono or polynuclear groups, (b) an alkyl group or mixed alkyl group of 1 to 10 carbon atoms in said alkyl group; an aromatic nitrile, an aliphatic nitrile, said aromatic or aliphatic group having from 1 up to 8 carbon atoms in said nitrile moiety; an aliphatic diene of 4 to 8 carbon atoms; an alicyclic diene, an alkylene diamine or a tetramine of 2 to 4 carbon atoms in the alkylene portion thereof; or triethanol or diethanol alkylamine of 1 to 4 carbon atoms in the alkyl group.

17. As an article of manufacture a nonconductive substrate having a circuit pattern thereon defined by an electroless metal deposit and as catalyst for said electroless deposit a thermal decomposition product of the complex defined in claim 9.

18. The article of manufacture as defined in claim 17 with an electrolytic overplate on said catalyst and electroless deposit.

19. The article of manufacture as defined in claim 17 and wherein the complex is trimethyl phosphite palladium dichloride.

20. As an article of manufacture, a polyimide film having a circuit pattern thereon defined by an electroless metal deposit and as catalyst for said electroless deposit a thermal decomposition product of a complex defined in claim 9.

* * * * *